US010031443B2

(12) United States Patent
Nagata

(10) Patent No.: US 10,031,443 B2
(45) Date of Patent: Jul. 24, 2018

(54) DEVELOPER SUPPLY DEVICE AND IMAGE FORMING APPARATUS

(71) Applicant: FUJI XEROX CO., LTD., Tokyo (JP)

(72) Inventor: Kenjo Nagata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/596,589

(22) Filed: May 16, 2017

(65) Prior Publication Data

US 2018/0059580 A1 Mar. 1, 2018

(30) Foreign Application Priority Data

Aug. 23, 2016 (JP) ..... 2016-163001

(51) Int. Cl.
*G03G 15/08* (2006.01)

(52) U.S. Cl.
CPC ..... *G03G 15/0898* (2013.01); *G03G 15/087* (2013.01); *G03G 15/0836* (2013.01); *G03G 15/0846* (2013.01)

(58) Field of Classification Search
CPC ..... G03G 15/0898; G03G 15/0836; G03G 15/0837; G03G 15/0839; G03G 15/0846; G03G 15/0867; G03G 15/0868; G03G 15/087; G03G 15/0872; G03G 15/0887; G03G 15/0889; G03G 15/0891
See application file for complete search history.

(56) References Cited

U.S. PATENT DOCUMENTS

2008/0056742 A1* 3/2008 Hattori ..... G03G 21/20 399/44
2012/0301188 A1* 11/2012 Yamabe ..... G03G 15/0832 399/262
2017/0090349 A1* 3/2017 Noguchi ..... G03G 15/0839

FOREIGN PATENT DOCUMENTS

JP 06121592 A * 4/1994
JP 2005-221976 A 8/2005
JP 2006208939 A * 8/2006
JP 2009-069177 A 4/2009

* cited by examiner

*Primary Examiner* — Carla Therrien
(74) *Attorney, Agent, or Firm* — Sughrue Mion, PLLC

(57) ABSTRACT

A developer supply device includes:
a device main body having a fixed portion;
a developer accommodating member including
a stationary portion fixed to the fixed portion,
a rotary portion, and
a seal member provided on one of an outer circumferential portion of the rotary portion and the stationary portion and being in contact with the other, a developer to be supplied to a developing device being accommodated in the rotary portion; and
a motor that rotates the rotary portion, wherein
the developer supply device has a first torque mode in which the motor rotates the rotary portion with a first rotational torque and a second torque mode in which the motor rotates the rotary portion with a second rotational torque higher than the first rotational torque when the motor rotates the rotary portion after a preset time or more elapses since the rotary portion stops rotating.

9 Claims, 4 Drawing Sheets

DEVELOPER SUPPLY DEVICE AND IMAGE FORMING APPARATUS

CROSS-REFERENCE TO RELATED APPLICATIONS

This application is based on and claims priority under 35 USC 119 from Japanese Patent Application No. 2016-163001 filed Aug. 23, 2016.

BACKGROUND

Technical Field

The present invention relates to a developer supply device and an image forming apparatus.

SUMMARY

According to an aspect of the invention, a developer supply device includes:

a device main body having a fixed portion;

a developer accommodating member including a stationary portion that is fixed to the fixed portion, a rotary portion that rotates relatively to the stationary portion, and a seal member that is provided on one of an outer circumferential portion of the rotary portion and the stationary portion and that is in contact with the other of the outer circumferential portion of the rotary portion and the stationary portion, wherein a developer to be supplied to a developing device is accommodated in the rotary portion; and a motor that rotates the rotary portion, wherein the developer supply device has a first torque mode and a second torque mode, in the first torque mode, the motor rotates the rotary portion with a first rotational torque, and in the second torque mode, the motor rotates the rotary portion with a second rotational torque higher than the first rotational torque when the motor rotates the rotary portion after a preset time or more elapses since the rotary portion stops rotating.

BRIEF DESCRIPTION OF THE DRAWINGS

Exemplary embodiments of the present invention will be described in detail based on the following figures, wherein.

DETAILED DESCRIPTION

[First Exemplary Embodiment]

An example of a developer supply device and an image forming apparatus according to a first exemplary embodiment will be described.

[Entire Configuration]

Figure 1:
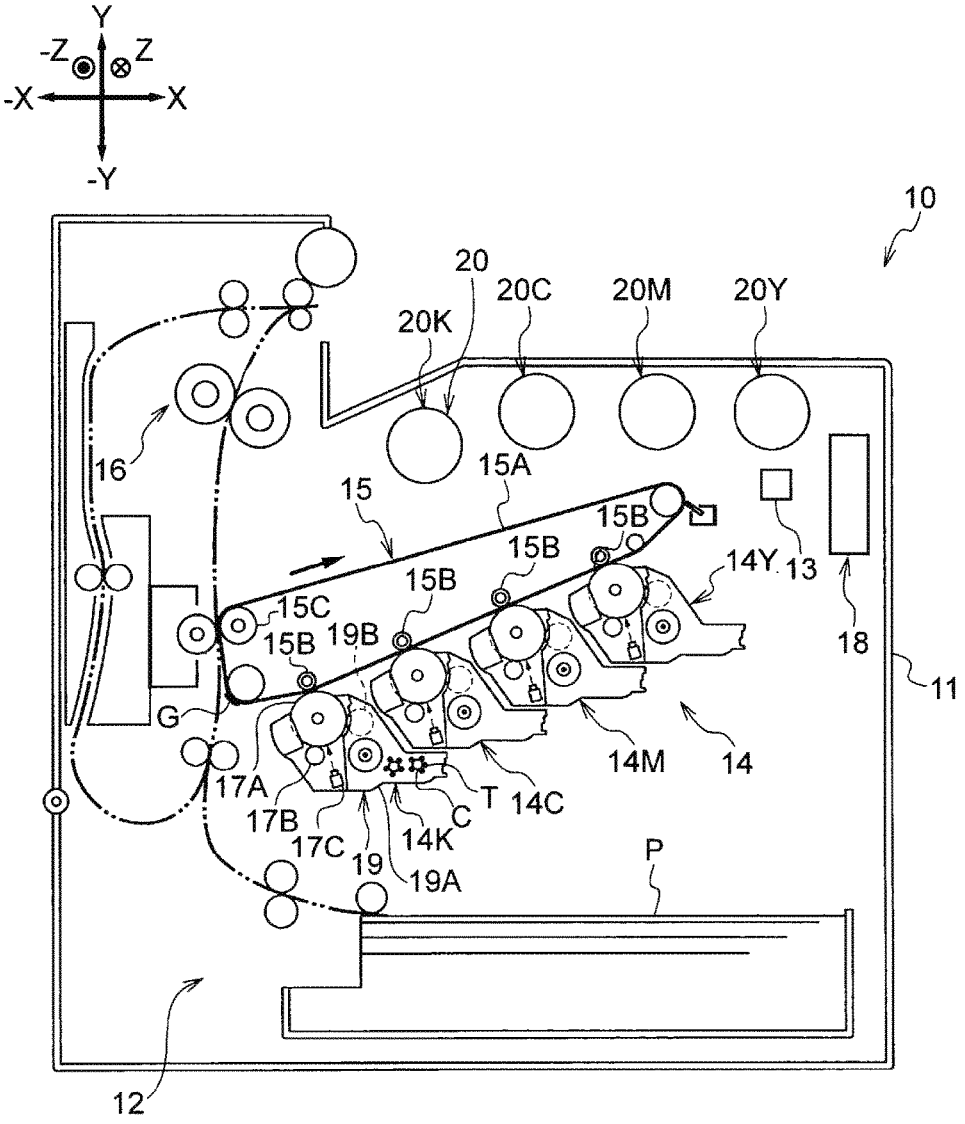
FIG. 1 is a view illustrating a configuration of an image forming apparatus according to a first exemplary embodiment.

An image forming apparatus 10 of the first exemplary embodiment is illustrated in FIG. 1. Further, in the following description, a direction indicated by arrow Y will be referred to as an apparatus height direction, and a direction indicated by arrow X will be referred to as an apparatus width direction in FIG. 1. In addition, a direction (indicated by Z) orthogonal to the apparatus height direction and the apparatus width direction will be referred to as an apparatus depth direction. Further, in the front view of the image forming apparatus 10, the apparatus height direction, the apparatus width direction, and the apparatus depth direction will be referred to as a Y direction, an X direction, and a Z direction, respectively. Further, if it is necessary to distinguish one side and the other side of each of the X direction, the Y direction, and the Z direction, an upper side is referred to as a Y side, a lower side will be referred to as a −Y side, a right side will be referred to as an X side, a left side will be referred to as a −X side, a depth side will be referred to as a Z side, and a front side will be referred to as a −Z side in a front view of the image forming apparatus 10.

The image forming apparatus 10 has a housing 11 having a box shape. In addition, in the housing 11, the image forming apparatus 10 has, for example, a transport unit 12, an image forming unit 14, a fixing unit 16, a controller 18, and a developer supply device 20. The transport unit 12 transports a sheet P as an example of a recording medium. An environmental sensor 13 is provided in the housing 11 to measure temperature and humidity in the interior of the housing 11 (around a toner cartridge 30 (see FIG. 2) to be described below).

The image forming unit 14 includes, for example, four image forming units 14Y, 14M, 14C, and 14K and a transfer device 15. In addition, the image forming unit 14 forms a toner image G on the sheet P transported by the transport unit 12 by using a carrier C and a toner T. The carrier C and the toner T are an example of a developer. The toner image G is an example of a developer image. The fixing unit 16 fixes the toner image G on the sheet P by heating and pressing the toner image G. The controller 18 is an example of a controller, and controls the operations of respective parts of the image forming apparatus 10.

Because the image forming units 14Y, 14M, 14C, and 14K have the same configuration except for the toner T (yellow, magenta, cyan, and black) to be used, the image forming unit 14K will be described, and descriptions of the image forming units 14Y, 14M, and 14C will be omitted.

The image forming unit 14K has a photoconductor 17A as an example of an image carrying member, a charging roller 17B, an exposure unit 17C, and a developing device 19. The photoconductor 17A is formed in a cylindrical shape. In addition, the photoconductor 17A is charged by the charging roller 17B and holds a latent image that is formed on the outer circumferential surface thereof by being exposed by the exposure unit 17C.

The developing device 19 has a main body unit 19A having a box shape, and a developing roller 19B rotatably provided in the main body unit 19A. The toner T and the carrier C are accommodated in the main body unit 19A. Further, the developing device 19 is configured to develop the latent image on the photoconductor 17A by using the toner T by rotating the developing roller 19B. Further, the toner T is supplied into the main body unit 19A from the developer supply device 20 to be described below.

The transfer device 15 includes an intermediate transfer belt 15A, four primary transfer rollers 15B which transfer the toner image G from the photoconductor 17A to the intermediate transfer belt 15A, and a single secondary transfer roller 15C which transfers the toner image G on the intermediate transfer belt 15A to the sheet P. Further, the transfer device 15 transfers the developed toner image G on the photoconductor 17A to the sheet P.

[Configuration of Main Part]

Next, the developer supply device 20 will be described.

As illustrated in FIG. 1, developer supply devices 20Y, 20M, 20C, and 20K are provided in the image forming apparatus 10 so as to correspond to the toner T (yellow, magenta, cyan, and black) to be used. Further, because the developer supply devices 20Y, 20M, 20C, and 20K have the same configuration except for the toner T, the developer supply devices 20Y, 20M, 20C, and 20K will be described as the developer supply device 20 here.

Figure 2:
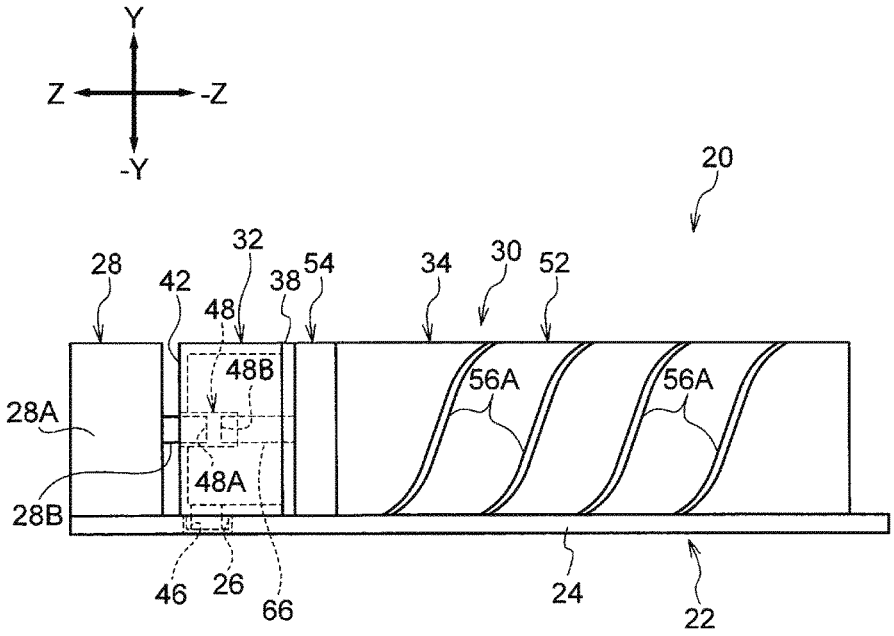
FIG. 2 is a view illustrating a configuration of a developer supply device according to the first exemplary embodiment.

As illustrated in FIG. 2, the developer supply device 20 has a device main body 22, the toner cartridge 30 as an example of a developer accommodating member, and a motor 28. Further, the operation of the motor 28 is adapted to be controlled by the controller 18 (see FIG. 1).

<Device Main Body>

The device main body 22 is fixed inside the housing 11 (see FIG. 1). In addition, the device main body 22 includes, for example, a bottom plate 24, a fixed portion 26, and a pair of non-illustrated side plates that stand upright in the Y direction from both end portions of the bottom plate 24 in the X direction, and the device main body 22 is formed to have a U shape in cross section when viewed in the Z direction.

Further, the device main body 22 is sized to be able to accommodate the toner cartridge 30 to be described below.

The bottom plate 24 extends along an X-Z plane. In addition, the toner cartridge 30 is mounted at the Y side of the bottom plate 24 so that an axial direction of the toner cartridge 30 extends in the Z direction. A bottom portion of the motor 28 is mounted at an end portion at the Z side of the bottom plate 24. The fixed portion 26 is, for example, configured with a hole portion that penetrates the bottom plate 24 in the Y direction on the −Z side of a portion where the motor 28 is mounted in the bottom plate 24.

<Toner Cartridge>

Figure 3:
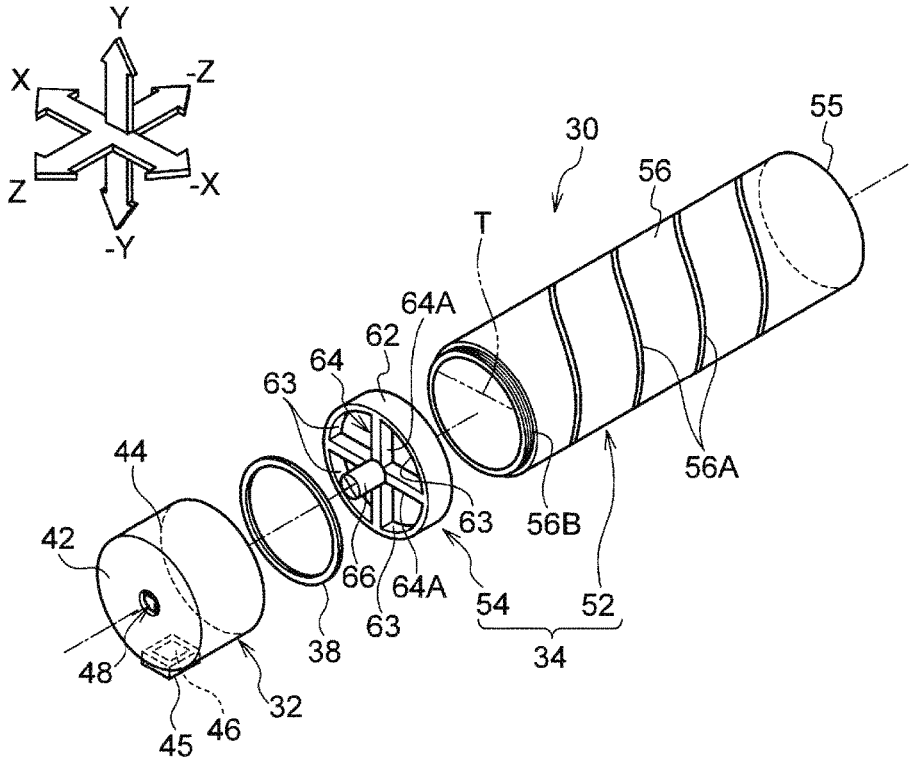
FIG. 3 is an exploded perspective view of a toner cartridge according to the first exemplary embodiment.

As illustrated in FIG. 3, as an example, the toner cartridge 30 has a stationary portion 32, a rotary portion 34, and a seal member 38. Further, an arrangement of respective parts of the toner cartridge 30 will be described in a state in which the toner cartridge 30 is fixed to the device main body 22 (see FIG. 2).

(Stationary Portion)

The stationary portion 32 is configured with a member made of a resin, formed in a cylindrical shape having an axial direction along the Z direction, having a bottom so that the member is closed at the Z side and opened at the −Z side. Further, as an example, the stationary portion 32 is made of ABS resin (acrylonitrile butadiene styrene copolymer rein). Specifically, the stationary portion 32 includes a vertical wall 42, a peripheral wall 44, and a coupling 48. The vertical wall 42 is formed in a circular shape when viewed in the Z direction.

The peripheral wall 44 extends toward the −Z side in the Z direction from an outer circumferential portion of the vertical wall 42, and is formed in a cylindrical shape. An end surface of the peripheral wall 44 at the −Z side is formed as an annular flat surface along an X-Y plane. In addition, a protruding portion 45, which protrudes toward the −Y side from the peripheral wall 44, is formed at the −Y side of the peripheral wall 44. A discharge port 46, which penetrates the peripheral wall 44 and the protruding portion 45 in the Y direction, is formed in the peripheral wall 44 and the protruding portion 45. The protruding portion 45 is sized and shaped to be fitted into the fixed portion 26 (see FIG. 2), and fixed to the fixed portion 26 by being fitted into the fixed portion 26.

The coupling 48 illustrated in FIG. 2 is formed in a cylindrical shape having an axial direction along the Z direction, and provided in the central portion of the vertical wall 42 to be rotatable about the axis thereof. In addition, a first connecting portion 48A which is a recess portion opened at the Z side and a second connecting portion 48B which is a recess portion opened at the −Z side are formed in the coupling 48.

(Rotary Portion)

As illustrated in FIG. 3, the rotary portion 34 includes, for example, a tubular part 52 and a mounting part 54.

The tubular part 52 is configured with a member made of a resin, formed in a cylindrical shape having an axial direction along the Z direction, and having a bottom so that the member is closed at the −Z side and opened at the Z side. Further, as an example, the tubular part 52 is made of a high density polyethylene (HDPE). As another example, the tubular part 52 may be made of a PET (polyethylene terephthalate) resin. Specifically, the tubular part 52 includes a bottom wall 55 and a peripheral wall 56. The bottom wall 55 is formed in a circular shape when viewed in the Z direction. The peripheral wall 56 extends toward the Z side in the Z direction from an outer circumferential portion of the bottom wall 55, and is formed in a cylindrical shape. In addition, a guide portion 56A, which is formed in a spiral shape and protrudes toward an interior of the peripheral wall 56, is formed on the peripheral wall 56. Further, a male screw portion 56B is formed at a Z side edge of the peripheral wall 56. Before the toner T is supplied to the developing device 19 (see FIG. 1), the toner T is accommodated within the tubular part 52.

The mounting part 54 is formed in a cylindrical shape having an axial direction along the Z direction. Specifically, the mounting part 54 includes a peripheral wall 62, a partition wall 64, and a shaft portion 66. The peripheral wall 62 is formed in a cylindrical shape extending in the Z direction. A female screw portion (not illustrated) is formed on an inner surface at the −Z side of the peripheral wall 62 to be engaged with the male screw portion 56B. The end surface of the peripheral wall 62 at the Z side is formed as an annular flat surface along the X-Y plane.

The partition wall 64 includes two walls 64A which are orthogonal to each other at the center of the peripheral wall 62 when the peripheral wall 62 is viewed in the Z direction. The partition wall 64 divides the interior of the peripheral wall 62 into four space portions 63. The shaft portion 66 is a columnar portion that has an axial direction along the Z direction and extends toward the Z side from a portion where the two walls 64A intersect each other. In addition, the shaft portion 66 is sized and shaped to be connected to the aforementioned second connecting portion 48B (see FIG. 2) and rotated integrally with the coupling 48. The length of the shaft portion 66 in the Z direction is shorter than the length of the peripheral wall 44 of the stationary portion 32 in the Z direction.

(Seal Member)

The seal member 38 is formed in an annular shape when viewed in the Z direction. In addition, as an example, the seal member 38 is made of urethane. The outer diameter of the seal member 38 has substantially the same as the outer diameter of the stationary portion 32 and the outer diameter of the rotary portion 34. The thickness of the seal member 38 in the Z direction is a thickness to which the seal member 38 is compressed in the Z direction in a state in which the shaft portion 66 of the rotary portion 34 is connected to the second connecting portion 48B (see FIG. 2). Further, the end surface of the seal member 38 at the Z side is bonded to the end surface of the stationary portion 32 at the −Z side by an adhesive. That is, as an example, the seal member 38 is provided in the stationary portion 32. In addition, the end surface of the seal member 38 at the −Z side is in contact with an end surface of a portion of the rotary portion 34 at an outer circumferential side at the Z side. Further, as another example, the seal member 38 may be made of a chloroprene rubber or a felt.

<Motor>

The motor 28 illustrated in FIG. 2 has a drive unit 28A which is controlled by the controller 18 (see FIG. 1), a shaft portion 28B which is rotated by the drive unit 28A, and a driver (not illustrated). The bottom portion of the drive unit 28A at the −Y side is fixed to the aforementioned bottom plate 24 by means of a fastener (not illustrated). The shaft portion 28B has an axial direction along the Z direction extends toward the −Z side from the drive unit 28A. In addition, the shaft portion 28B is sized and shaped to be connected to the aforementioned first connecting portion 48A. The length of the shaft portion 28B in the Z direction is a length along which the shaft portion 28B and the first connecting portion 48A are connected to each other when the toner cartridge 30 is fixed to the device main body 22.

The motor 28 is configured to rotate the rotary portion 34 about the Z axis by rotating the shaft portion 66 after the shaft portion 66 is connected through the coupling 48. Further, as the rotary portion 34 rotates relatively to the stationary portion 32, the toner T in the tubular part 52 is guided by the guide portion 56A, passes through the space portions 63 (see FIG. 3), and is supplied to a toner supply path (not illustrated) from the discharge port 46. Further, as an example, in the present exemplary embodiment, the motor 28 is configured with a stepping motor having properties in which rotational torque is increased as a rotational speed (the number of revolutions) is decreased from a preset speed.

(Controller)

The controller 18 illustrated in FIG. 1 includes a CPU (central processing unit), a ROM (read only memory), a RAM (random access memory), and the like, as an example of a computer, which are not illustrated. The transport unit 12, the image forming unit 14, the fixing unit 16, the motor 28 (see FIG. 2), and the environmental sensor 13 are connected to the controller 40 through a bus (not illustrated). In addition, a timer (not illustrated) is provided in the controller 18 to measure time. The controller 18 allows the motor 28 to rotate at a low speed and with a high torque by reducing the number of pulses (the number of pulses corresponding to the number of revolutions), which is input to the non-illustrated driver of the motor 28, to be smaller than the number of pulses during a normal rotation.

<Setting of Necessary Torque>

The controller 18 has a first torque mode and a second torque mode as modes for setting a necessary torque required to rotate the motor 28.

The first torque mode is a mode in which the motor 28 rotates the rotary portion 34 with a first rotational torque (referred to as TA). As an example, the first rotational torque TA is set to a necessary torque when the motor 28 begins to rotate and then continuously rotates in a state in which a temperature of 22° C. and humidity of 55% are detected by the aforementioned environmental sensor 13 (see FIG. 1). In addition, the first rotational torque TA is set to, for example, 0.9 N·m.

The second torque mode is a mode in which the motor 28 rotates the rotary portion 34 with a second rotational torque (referred to as TB) higher than the first rotational torque TA when rotating the rotary portion 34 after a preset time (referred to as Δt) or more has elapsed since the stopping of the rotary portion 34. The second rotational torque TB is set to a necessary torque required to allow the motor 28 to begin to rotate. The preset time Δt (not illustrated) is set to, for example, four hours.

For example, the second rotational torque TB is set to a high torque in accordance with elapsed time t measured by the aforementioned timer (not illustrated) in a state in which a temperature of 22° C. and humidity of 55% are detected by the aforementioned environmental sensor 13 (see FIG. 1). The elapsed time t refers to a time equal to or longer than the preset time Δt, and the elapsed time t is elapsed time from a time point at which the rotary portion 34 stops rotating. For example, the elapsed time t is 4 hours at a time point at which four hours have elapsed from a time point at which the motor 28 (rotary portion 34) stops rotating in a previous step.

As represented in Table 1, for example, the second rotational torque TB is set to 1.0 N·m when the elapsed time t is 4 hours, that is, when the preset time Δt has elapsed. Further, for example, under an environment with a temperature of 22° C. and humidity of 55%, the second rotational torque TB is set to 1.4 N·m when the elapsed time t exceeds four hours and is eight hours or less, and set to 1.6 N·m when the elapsed time t exceeds eight hours and is twelve hours or less. As described above, the necessary torque of the motor 28 is set to be increased when the elapsed time t is increased. In other words, the controller 18 is set to increase the second rotational torque TB according to the elapsed time t (when the elapsed time is increased). This is because an adhesive force between the seal member 38 (see FIG. 2) and the stationary portion 32 and an adhesive force between the seal member 38 and the rotary portion 34 (see FIG. 2) tend to increase over time.

TABLE 1

| | Elapsed Time t [hour] | | |
|---|---|---|---|
| | T = 4 | 4 < t ≤ 8 | 8 < t ≤ 12 |
| Second Rotational Torque TB [N · m] | 1.0 | 1.4 | 1.6 |

Figure 4:
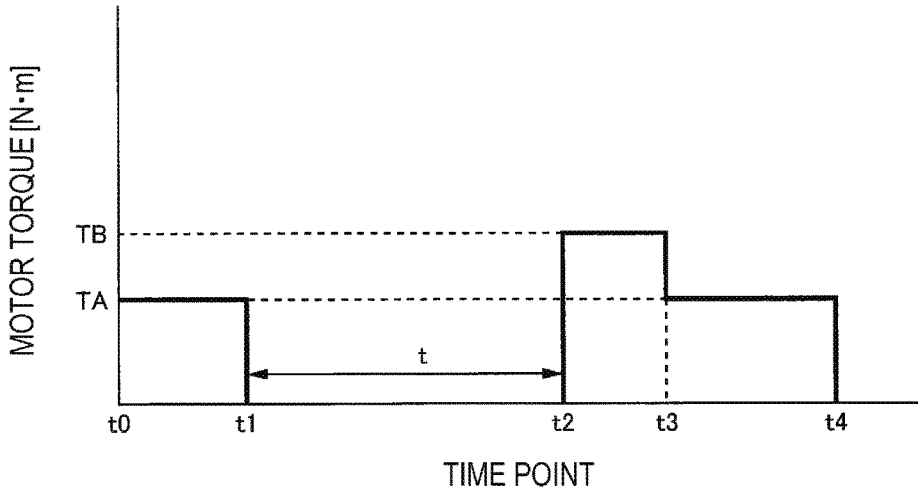
FIG. 4 is an explanatory view illustrating setting of a motor torque according to the first exemplary embodiment.

FIG. 4 illustrates the torque of the motor 28 (see FIG. 2) at respective points in time set to the controller 18 (see FIG. 1). Time point t0 is a time point during the motor 28 rotates in a previous step. Time point t1 is a time point at which the motor 28 stops rotating in the previous step. Time point t2 is a time point (t2=t1+t) at which the elapsed time t, which is the preset time Δt or more, has elapsed from time point t1, that is, a time point at which the motor 28 begins to rotate in a current step. Time point t3 is a time point at which the motor 28 begins to rotate such that the influence of the adhesive force of the seal member 38 (see FIG. 2) is decreased. Time point t4 is a time point at which the motor 28 stops rotating in the current step.

From time point t0 to time point t1, the first rotational torque TA is set as the torque of the motor 28. From time point t1 to time point t2, the motor 28 is stopped. From time point t2 to time point t3, the second rotational torque TB (>TA) is set. From time point t3 to time point t4, the first rotational torque TA is set. As described above, the controller 18 is configured to rotate the motor 28 with high torque (second rotational torque TB) when the elapsed time t has elapsed from the time point at which the motor 28 stops rotating in the previous step, and rotate the motor 28 with low torque (first rotational torque TA) after the motor 28 begins to rotate. Further, the second rotational torque TB is increased when the elapsed time t is increased.

In addition, the controller 18 is configured to control the rotary portion 34 (see FIG. 2) so that, in execution of the second torque mode, the rotary portion 34 continuously rotates until an accumulated amount of rotation amount from the time point at which the motor 28 begins to rotate to the time point at which the motor 28 stops rotating reaches a preset amount. As described above, the motor 28 is configured as a stepping motor so that the motor 28 has a property of increasing rotational torque as the rotational speed is decreased from a preset speed. In other words, the number of revolutions of the motor 28 is decreased to output a high torque (second rotational torque TB). For this reason, the controller 18 is configured to allow the motor 28 to continuously rotate from time point t2 to time point t4 at which the aforementioned accumulated amount of the motor 28 reaches the preset amount, in order to supplement a rotation amount as much as an incremental difference from a case in which the motor 28 rotates with the first rotational torque TA from time point t2 to time point t3. Here, if t<4 under the same condition except for the elapsed time t, the preset amount is identical to the rotation amount of the motor 28 until the motor 28 stops rotating after the motor 28 begins to rotate with the first rotational torque TA. In other words, if t<4, the motor 28 continuously rotates for a period of time longer than that in a case in which the motor 28 rotates with the first rotational torque TA until a replenished amount is secured to be equal to a replenished amount of the toner T from the time point at wt which the motor 28 begins to rotate with the first rotational torque TA to the time point at which the motor 28 stops rotating.

[Operation]

Next, an operation of the first exemplary embodiment will be described.

Figure 5:
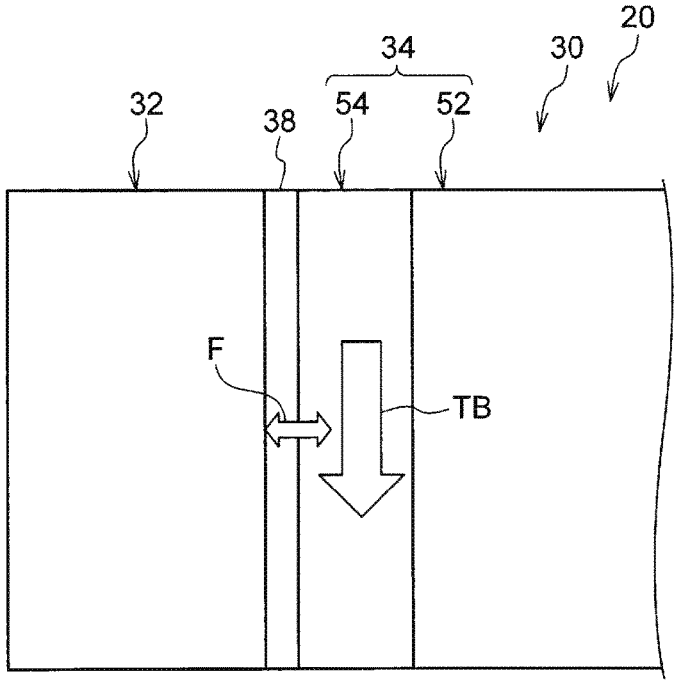
FIG. 5 is an explanatory view schematically illustrating a force applied to the toner cartridge according to the first exemplary embodiment.

The operations of the image forming apparatus 10 and the developer supply device 20 will be described with reference to FIGS. 1 to 5, as an example of the present disclosure. FIG. 5 illustrates a state in which the rotary portion 34 is rotated with the second rotational torque TB in a state in which adhesive force F is applied between the seal member 38 and the rotary portion 34.

In the developer supply device 20, the controller 18 sets a rotational torque of the motor 28 at time point t2 to the second rotational torque TB. The time point t2 is a time point at which the elapsed time t has elapsed since time point t1 at which the rotary portion 34 stops rotating (is stopped) in the previous step. Further, as the motor 28 rotates the rotary portion 34 with the second rotational torque TB, the rotary portion 34 begins to rotate. Here, even though the adhesive force F between the seal member 38 and the rotary portion 34 is increased because the elapsed time t, which is the preset time Δt or more, elapses, the rotary portion 34 begins to rotate against the adhesive force F because the rotational torque of the motor 28 is set to the second rotational torque TB. For this reason, as compared with a configuration in which rotational torque of the motor 28 is constant, it is possible to inhibit a state in which the motor 28 does not rotate when the rotary portion 34 is rotated after being left as it is for the elapsed time t.

When the elapsed time t is increased, the controller 18 of the developer supply device 20 is set to increase the second rotational torque TB. For this reason, even though the elapsed time t is increased such that the adhesive force F between the seal member 38 and the rotary portion 34 is further increased, the rotary portion 34 begins to rotate against the adhesive force F because the second rotational torque TB of the motor 28 is increased. That is, as compared with a configuration in which the second rotational torque TB is constant, it is possible to inhibit a state in which the motor 28 does not rotate when rotating the rotary portion 34 after being left as it is.

In the developer supply device 20, the motor 28 is configured with a stepping motor, and continuously rotates until the accumulated amount from the time point at which the motor 28 begins to rotate to the time point at which the motor 28 stops rotating reaches the preset amount. For this reason, the supply amount of toner T to be supplied to the developing device 19 is increased as compared with a configuration in which the number of revolutions of the motor 28 is decreased to obtain the second rotational torque TB and the motor 28 does not continuously rotate until the accumulated amount from the time point at which the motor 28 begins to rotate to the time point at which the motor 28 stops rotating reaches the preset amount. Therefore, an insufficient supply amount of toner T in a case in which the number of revolutions of the motor 28 is decreased is inhibited.

In the image forming apparatus 10, because a supply of a toner T by the developer supply device 20 is not stopped after the elapsed time t has elapsed, a state in which the toner image G cannot be formed (an image cannot be formed) is inhibited as compared with a configuration that does not have the developer supply device 20.

[Second Exemplary Embodiment]

Next, an example of a developer supply device and an image forming apparatus according to a second exemplary embodiment will be described with reference to FIGS. 1 to 6. Further, members and parts, which are basically identical to those in the aforementioned first exemplary embodiment, are designated by the same reference numerals as those in the first exemplary embodiment, and descriptions thereof will be omitted.

In the second exemplary embodiment, setting of a necessary torque of the motor 28 by the controller 18 in the image forming apparatus 10 and the developer supply device 20 of the first exemplary embodiment is changed. The configurations other than the setting of the necessary torque are similar to those of the image forming apparatus 10 and the developer supply device 20 of the first exemplary embodiment.

<Setting of Necessary Torque>

The controller 18 of the second exemplary embodiment has the first torque mode and the second torque mode as modes for setting a necessary torque required to rotate the motor 28. In addition, when executing the second torque mode, the controller 18 of the second exemplary embodiment is configured to change the second rotational torque TB according to an environment (temperature and humidity).

Specifically, for example, if temperature and humidity around the toner cartridge 30 are high in execution of the second torque mode, the controller 18 is set to increase the second rotational torque from TB to TC (>TB) as compared with a case in which temperature and humidity around the toner cartridge 30 are low. As represented in Table 2, the second rotational torques TB and TC are set as a necessary torque required to allow the motor 28 to begin to rotate according to temperature and humidity detected by the environmental sensor 13 (see FIG. 1). Further, even in the second exemplary embodiment, the second rotational torque TB is set to be increased according to the aforementioned elapsed time t (in a case in which the elapsed time t is increased).

TABLE 2

| | Elapsed Time t [hour] | | |
|---|---|---|---|
| | T = 4 | 4 < t ≤ 8 | 8 < t ≤ 12 |
| Environment A Second Rotational Torque TB [N · m] | 1.1 | 1.6 | 1.8 |
| Environment B Second Rotational Torque TB [N · m] | 1.0 | 1.4 | 1.6 |
| Environment C Second Rotational Torque TB [N · m] | 0.9 | 1.0 | 1.1 |

In Table 2, environment A is an environment at a temperature of 28° C. and humidity of 85%. Environment B is an environment at a temperature of 22° C. and humidity of 55%. Environment C is an environment at a temperature of 10° C. and humidity of 15%. Environment A, Environment B, and Environment C are examples of a high-temperature and high-humidity environment, a normal-temperature and normal-humidity environment, and a low-temperature and low-humidity environment, respectively. Further, in the present exemplary embodiment, the first rotational torque is set to, for example, TA=0.9 N·m. For this reason, in the case of the elapsed time t, the temperature, and the humidity in which the necessary torque is 0.9 N·m or less, the controller 18 sets the second rotational torque TB=the first rotational torque TA=0.9 N·m.

Figure 6:
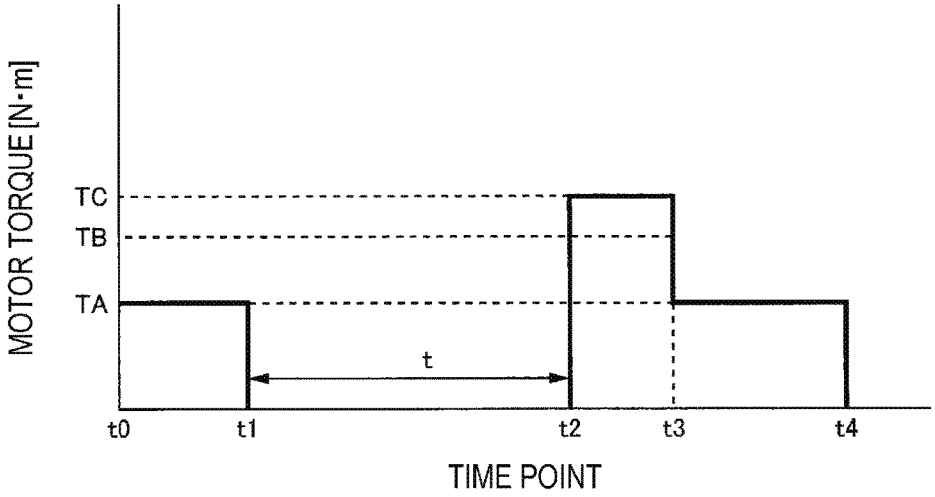
FIG. 6 is an explanatory view illustrating setting of a motor torque according to a second exemplary embodiment.

FIG. 6 illustrates the torque of the motor 28 (see FIG. 2) at respective time points set to the controller 18 (see FIG. 1) of the second exemplary embodiment. Time points t0, t1, t2, t3, and t4 are time points identical to those in the first exemplary embodiment.

From time point t0 to time point t1, the first rotational torque TA is set as the torque of the motor 28. From time point t1 to time point t2, the motor 28 is stopped. Further, the controller 18 is configured to select the torque of the motor 28 based on information about temperature and humidity obtained by the environmental sensor 13 between time point t1 and time point t2. Here, if the elapsed time t is increased as described above, the controller 18 is set to increase the second rotational torque TB.

If the elapsed time t is increased and temperature and humidity around the toner cartridge 30 (see FIG. 2) are high in execution of the second torque mode, the second rotational torque TB is selected which is higher than that in a case in which temperature and humidity around the toner cartridge 30 are low. For example, as represented in Table 2, if a condition about temperature and humidity is identical to that of Environment B when the elapsed time t is four hours under Environment B, the second rotational torque TB is set to 1.4 N·m. Meanwhile, if temperature and humidity are changed from Environment B to Environment A, the second rotational torque TB is set to 1.6 N·m. As described above, in the second exemplary embodiment, if temperature and humidity are increased, the second rotational torque TC higher than the second rotational torque TB is set from time point t2 to time point t3. In addition, from time point t3 to time point t4, the first rotational torque TA is set.

In addition, the controller 18 of the second exemplary embodiment is configured to control the rotary portion 34 (see FIG. 2) so that, in execution of the second torque mode, the rotary portion 34 continuously rotates until an accumulated amount from the time point at which the motor 28 begins to rotate to the time point at which the motor 28 stops rotating reaches a preset amount.

[Operation]

Next, an operation of the second exemplary embodiment will be described.

Operations of the image forming apparatus 10 and the developer supply device 20 of the second exemplary embodiment will be described with reference to FIGS. 1, 2, 3, 5, and 6. Further, a description of an operation identical to that in the first exemplary embodiment will be omitted.

In the developer supply device 20 in the second exemplary embodiment, the controller 18 obtains information about temperature and humidity from the environmental sensor 13 after the elapsed time t has elapsed from time point t1 at which the rotary portion 34 stops rotating (is stopped) in the previous step. Further, for example, the controller 18 sets the rotational torque of the motor 28 to the second rotational torque TC when temperature and humidity are increased from Environment B to Environment A. Further, as the motor 28 rotates the rotary portion 34 with the second rotational torque TC, the rotary portion 34 begins to rotate.

Here, even though the adhesive force F between the seal member 38 and the rotary portion 34 is increased because the elapsed time t elapses and temperature and humidity are increased, the rotary portion 34 rotates against the adhesive force F because the rotational torque of the motor 28 is set to second rotational torque TC. For this reason, a state in which the motor 28 does not rotate when rotating the rotary portion 34 after being left as it is for the elapsed time t and when temperature and humidity are increased is inhibited in comparison with a configuration in which rotational torque of the motor 28 is not changed from the second rotational torque TB.

The present invention is not limited to the exemplary embodiments.

If a supply amount of a toner T to the developing device 19 is not insufficient in the developer supply device 20 of the first exemplary embodiment, the rotary portion 34 may not continuously rotate until the accumulated amount of the rotation of the motor 28 reaches the preset amount.

In the developer supply device 20 in the second exemplary embodiment, the second rotational torque TC is set in a case in which temperature and humidity are increased as an example of the second torque mode. Alternatively, the second rotational torque TC may be set in a case in which only a temperature is increased or only humidity is increased. In addition, if a supply amount of toner T to the developing device 19 is not insufficient in the developer supply device 20 of the second exemplary embodiment, the rotary portion 34 may not continuously rotate until the accumulated amount from the time point at which the motor 28 begins to rotate to the time point at which the motor 28 stops rotating reaches the preset amount.

The setting of the first rotational torque TA and the second rotational torque TB and TC may be set to time exceeding eight hours in addition to the setting within eight hours as represented in Tables land 2. The preset time Δt is not limited to four hours, and may be set to time less than or more than four hours. The elapsed time t is not limited to every four hours, and may be set to time less than or more than four hours.

The image forming apparatus 10 is not limited to using four color toners T, and a one color toner T, two color toners T, three color toners T, or five or more color toners T may be used.

The motor 28 is not limited to the stepping motor, and may be configured with a direct current (DC) motor. In the case of the DC motor, voltage values and current values, which are higher than normal values, may be set to increase torque.

A configuration of the seal member 38 is not limited to the configuration in which the seal member 38 is provided in the stationary portion 32 and is in contact with a portion at an outer circumferential side of the rotary portion 34, and the seal member 38 may be provided at a portion at an outer circumferential side of the rotary portion 34 and may be in contact with the stationary portion 32.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer supply device comprising:

a device main body having a fixed portion;

a developer accommodating member including a stationary portion that is fixed to the fixed portion, a rotary portion that rotates relatively to the stationary portion, and a seal member that is provided on one of an outer circumferential portion of the rotary portion and the stationary portion and that is in contact with the other of the outer circumferential portion of the rotary portion and the stationary portion, wherein a developer to be supplied to a developing device is accommodated in the rotary portion; and a motor that rotates the rotary portion, wherein the developer supply device has a first torque mode and a second torque mode, in the first torque mode, the motor rotates the rotary portion with a first rotational torque, and in the second torque mode, the motor rotates the rotary portion with a second rotational torque higher than the first rotational torque when the motor rotates the rotary portion after a preset time or more elapses since the rotary portion stops rotating, wherein the second rotational torque is increased in accordance with elapsed time after the rotary portion stops rotating.

2. The developer supply device according to claim 1, wherein the motor is a stepping motor of which a rotational torque is increased as a rotational speed is decreased from a preset speed, and when the second torque mode is executed, the rotary portion continuously rotates until an accumulated amount of a rotation amount from a time point at which the motor begins to rotate to a time point at which the motor stops rotating reaches a preset amount.

3. An image forming apparatus comprising:

the developer supply device according to claim 1;

a developing device that develops a latent image on an image carrying member with the developer supplied from the developer supply device; and a transfer device that transfers a developer image on the image carrying member developed with the developer to a recording medium.

4. A developer supply device comprising:

a device main body having a fixed portion;

a developer accommodating member including a stationary portion that is fixed to the fixed portion, a rotary portion that rotates relatively to the stationary portion, and a seal member that is provided on one of an outer circumferential portion of the rotary portion and the stationary portion and that is in contact with the other of the outer circumferential portion of the rotary portion and the stationary portion, wherein a developer to be supplied to a developing device is accommodated in the rotary portion; and a motor that rotates the rotary portion, wherein the developer supply device has a first torque mode and a second torque mode, in the first torque mode, the motor rotates the rotary portion with a first rotational torque, and in the second torque mode, the motor rotates the rotary portion with a second rotational torque higher than the first rotational torque when the motor rotates the rotary portion after a preset time or more elapses since the rotary portion stops rotating, wherein when at least one of temperature and humidity around the developer accommodating member is high in execution of the second torque mode, the second rotational torque is increased as compared with a case in which the at least one of the temperature and the humidity around the developer accommodating member is low.

5. The developer supply device according to claim 4, wherein the second rotational torque is increased in accordance with elapsed time after the rotary portion stops rotating.

6. The developer supply device according to claim 4, wherein the motor is a stepping motor of which a rotational torque is increased as a rotational speed is decreased from a preset speed, and when the second torque mode is executed, the rotary portion continuously rotates until an accumulated amount of a rotation amount from a time point at which the motor begins to rotate to a time point at which the motor stops rotating reaches a preset amount.

7. An image forming apparatus comprising:

the developer supply device according to claim 4;

a developing device that develops a latent image on an image carrying member with the developer supplied from the developer supply device; and a transfer device that transfers a developer image on the image carrying member developed with the developer to a recording medium.

8. A developer supply device comprising:

a device main body having a fixed portion;

a developer accommodating member including a stationary portion that is fixed to the fixed portion, a rotary portion that rotates relatively to the stationary portion, and a seal member that is provided on one of an outer circumferential portion of the rotary portion and the stationary portion and that is in contact with the other of the outer circumferential portion of the rotary portion and the stationary portion, wherein a developer to be supplied to a developing device is accommodated in the rotary portion; and a motor that rotates the rotary portion, wherein the developer supply device has a first torque mode and a second torque mode, in the first torque mode, the motor rotates the rotary portion with a first rotational torque, and in the second torque mode, the motor rotates the rotary portion with a second rotational torque higher than the first rotational torque when the motor rotates the rotary portion after a preset time or more elapses since the rotary portion stops rotating, wherein the motor is a stepping motor of which a rotational torque is increased as a rotational speed is decreased from a preset speed, and when the second torque mode is executed, the rotary portion continuously rotates until an accumulated amount of a rotation amount from a time point at which the motor begins to rotate to a time point at which the motor stops rotating reaches a preset amount.

9. An image forming apparatus comprising:

the developer supply device according to claim 8;

a developing device that develops a latent image on an image carrying member with the developer supplied from the developer supply device; and a transfer device that transfers a developer image on the image carrying member developed with the developer to a recording medium.

* * * * *